United States Patent [19]

Cavalieri

[11] 4,228,989

[45] Oct. 21, 1980

[54] ACTUATOR FOR THE RELEASE MECHANISM OF A WINCH RECEIVING A TRACTION ROPE THERETHROUGH

[75] Inventor: Michel Cavalieri, Neuilly sur Marne, France

[73] Assignee: Tractell S.A., France

[21] Appl. No.: 15,072

[22] Filed: Feb. 26, 1979

[30] Foreign Application Priority Data

Mar. 1, 1978 [FR] France ..... 78 05835

[51] Int. Cl.[3] ..... B66F 3/00

[52] U.S. Cl. ..... 254/384; 254/106

[58] Field of Search ..... 254/76, 105–107, 254/135 R; 24/134 N

[56] References Cited

U.S. PATENT DOCUMENTS

| | | | |
|---|---|---|---|
| 3,863,893 | 2/1975 | Cavalieri | 254/76 |
| 3,981,483 | 9/1976 | Rinio | 254/76 |

*Primary Examiner*—Robert C. Watson

*Attorney, Agent, or Firm*—William Drucker

[57] ABSTRACT

This traction apparatus for hauling in and out a rope, of the type comprising a linkage mechanism adapted to actuate by turns two self-clamping pairs of jaws performing alternate to-and-fro movements, comprises a safety release device coupled to one of the levers of the mechanism, this device comprising essentially a push knob for releasing a two-armed strap normally held in locking engagement with the edges of apertures formed in the half-casings of the apparatus, push members associated with the outer bent arms of this strap and a U-shaped rod surrounded by pre-clamping springs and operatively connected to the strap, so that the rope cannot be released by the clamping jaws unless the operator pushes with both hands the push members subsequent to the depression of the push knob.

6 Claims, 7 Drawing Figures

ACTUATOR FOR THE RELEASE MECHANISM OF A WINCH RECEIVING A TRACTION ROPE THERETHROUGH

BACKGROUND OF THE INVENTION

1. Field of the Invention

The present invention relates in general to traction apparatus of the type designed for hauling in or out a metal rope by means of a linkage mechanism adapted to impart a to-and-fro movement to two pairs of self clamping jaws, one pair of jaws tightly clamping the rope and moving in the same direction as the rope while the other pair of jaws is released from the rope and moves in the opposite direction.

2. Description of the Prior Art

The U.S. Pat. No. 3,863,893 a modified, lighter construction of an apparatus of this type in which all the component elements of the linkage mechanism are steel stampings, so that manufacturing costs are cut considerably, and wherein the slack end of the rope emerging from one lateral side of the casing is guided by a deflector, so that a very compact and flat apparatus is obtained.

In the construction according to the above-mentioned reference patent the release control member consists of a strap, comprising two rigidly interconnected parallel arms and incorporating at its outer end a flat push knob, this strap bearing with its inner end against a pair of compression springs exerting a pre-clamping pressure on the rope-clamping linkage mechanism.

This strap has a notch formed therein so that, when the strap is pushed against the force of the pre-clamping springs, it can be locked in relation to a latch member, for example the edge of an aperture formed in the casing and slidably engaged by this strap.

In the depressed position, the thus actuated strap compresses the pre-clamping springs associated with the pairs of self-clamping jaws. If an additional pressure is exerted on the strap end while moving it slightly in a lateral direction, the aforesaid notch is released, thus enabling the strap to slide outwardly and to allow the springs to expand, thus eliminating the pressure exerted by the springs on the pairs of self-clamping jaws, so that the rope can be caused to slide freely by hand through the apparatus.

SUMMARY OF THE INVENTION

It is the object of the present invention to provide means for locking and releasing the rope release control strap, so that any undesired release as a consequence of an untimely or unintentional movement is definitively precluded.

For this purpose, the release strap consists of a flat iron strip bent to a U-shaped configuration so as to provide two substantially parallel arms having their ends bent outwardly.

These two arms are so disposed as a consequence of the bending of their end protions that each end is adapted to exert a lateral outward force counteracted by the side walls of the casing.

For cooperating with the strap and constituting a setting device, the casing of the apparatus has formed in each lateral face an aperture registering with the bent end of the relevant arm of the strap in a predetermined retracted or collapsed position of this strap. In this position, the strap arms are allowed to expand and their outwardly bent ends engage, and are retained by, the edge of the corresponding aperture.

On each lateral aperture of the apparatus a push member is provided so that the end of the corresponding arm of the strap can be pressed inwards.

Each strap arm end makes an obtuse angle with a transverse intermediate portion of the strap arm and this portion is engaged by a pre-clamping coil compression spring or a complementary release spring, so that the strap end has a hook-like configuration. Consequently, to release the pre-clamping strap it is necessary to depress its end knob in order to cause this strap to be sunk to a greater extent into the casing of the apparatus, whereafter a lateral inward pressure must be exerted on both push members. Thus, the ends of the two strap arms are disengaged from their resilient bearing contact with the edges of the corresponding casing apertures and the release strap can slide outwardly under the pressure of the pre-clamping or trigger springs. In either case, the movement of the release strap to its outermost position will release the rope through the action of means to be described hereinafter.

Compared with the above-mentioned prior art device, the device of the instant invention is advantageous in that its actuation requires the cooperation of both operator's hands according to coordinated and therefore conscious movements, so that any unintentional wrong move is positively precluded.

In case the ends of the release strap were also intended for acting as bearing or reaction elements to the pre-clamping springs, one might object in this arrangement to the fact that the operator might carelessly attempt to use the winch in the release condition to avoid the effort necessary for re-clamping the rope. On the other hand, a possible and not sufficiently controlled wear and tear of the setting system consisting of the interlocking of the control strap in the rope-clamping position might jeopardize the keeping of the winch in its rope clamping position.

To avoid these inconveniences, the present invention provides three different forms of embodiment so designed that the movement for releasing the rope-release strap or like member is obtained by pulling said strap against the force of the pre-clamping springs, a latch mechanism being provided for holding the assembly in its release condition notwithstanding the action exerted by the pre-clamping springs. These pre-clamping springs can then be either transferred to the clamping jaw-block assemblies or positioned around the arms of a release transmission rod by reacting in this case not against the ends of the release strap but against fixed points rigid with the casing of the apparatus.

IN THE DRAWINGS

DESCRIPTION OF THE PREFERRED EMBODIMENTS

Figure 1:
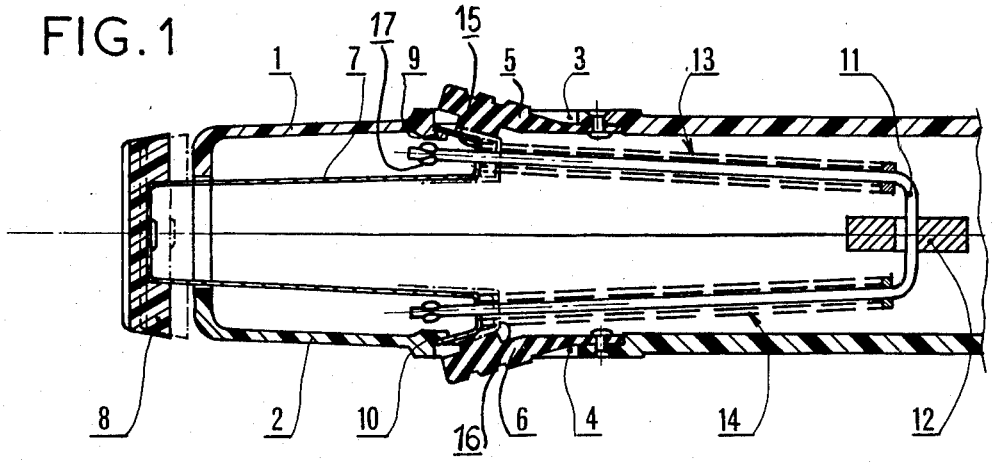
FIG. 1 is a cross section showing diagrammatically the position of the various component elements of the device in its clutching position, according to a first form of embodiment, the dash lines showing the position of the same component elements after an additional pressure has been exerted on the end push knob for starting the elimination of the pre-clamping action (release)

Referring first to FIG. 1 of the drawings, showing the complete mechanism of the device, a pair of half-shells 1 and 2 constituting the casing of the device have formed therein a pair of diametrally opposite apertures 3 and 4 adapted to receive lateral push members 5 and 6 consisting of a material having a flexibility sufficient to enable these members 5 and 6 to resume their initial position when released after undergoing a slight inward bending pressure. FIG. 1 also shows the U-shaped release or declutching strap 7 with its end push-knob 8, these two members being assembled by rivetting. The end of each arm of the U-shaped strap 7 are bent twice to a suitable configuration enabling these arms to be locked on the edge of the corresponding aperture 3 or 4 formed in each casing half 1, 2. This edge may comprise if desired an internal projection 9, 10 for reinforcing the hooking, retaining or latching action exerted on the end of each arm of strap 7.

Another member or rod 11 also of U-like configuration comprises two arms extending each freely through an intermediate transverse portion 15, 16 of the corresponding end portion of one arm of said first strap 7. Each arm of this U-shaped rod 11 is adapted to guide one of the springs 13, 14 reacting with one end against one point of rod 11 and with the opposite end on the corresponding transverse portion 15, 16 of the strap 7. Thus, the resilient pressure of the springs is transmitted to a member 12 of the clamping linkage system of the hauling apparatus.

Each free end of rod 11 comprises an enlarged stop point 17 for preventing the end of the corresponding arm of the release strap 7 from being disconnected from the associated arm of rod 11.

The permissible lash of the transmission member 12 is relatively small in comparison with that of the strap and rod assembly 7, 11; therefore, it is obvious that this member 12 will not act as a reaction member to both pre-clamping springs 13, 14.

Figure 4:
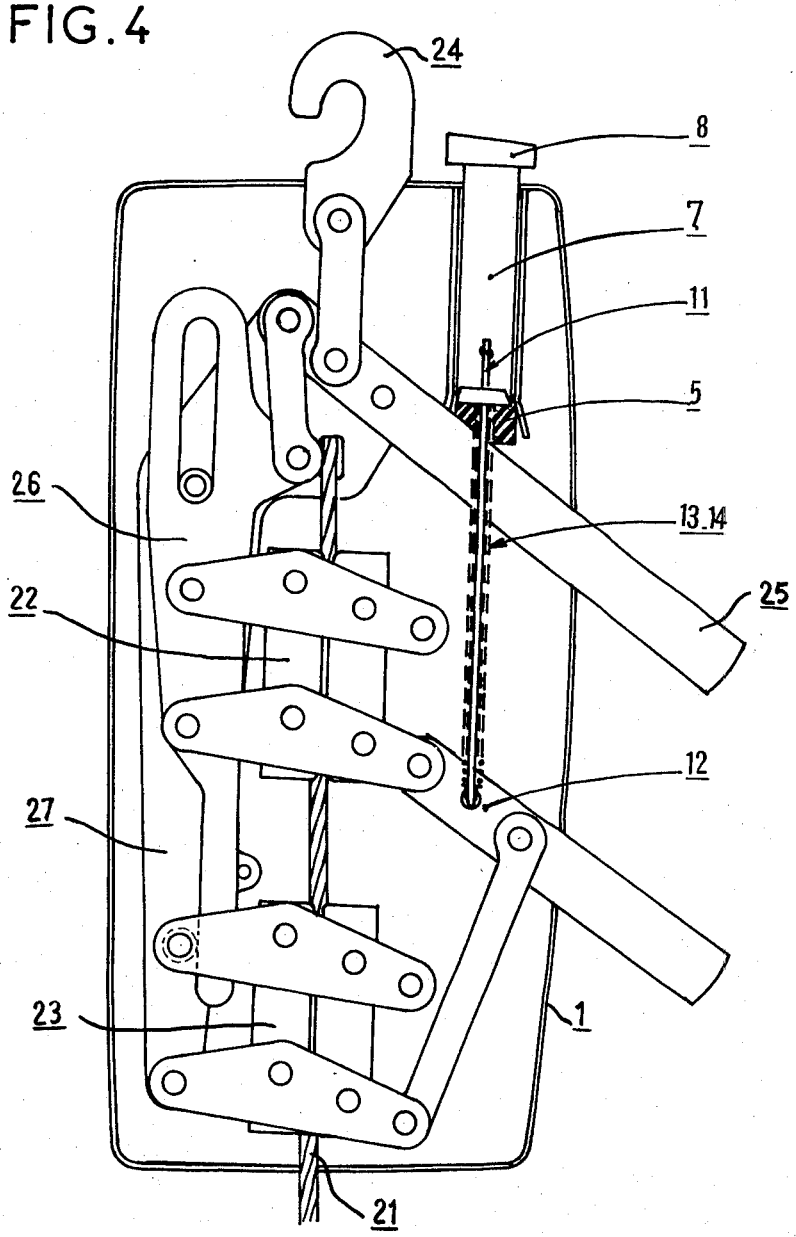
FIG. 4 is a side elevational view of the winch mechanism according to the above-mentioned reference patent.

FIG. 4 illustrates in side elevational view the winch mechanism enclosed in the half-casing. Since this mechanism is well known and at any rate described and illustrated in the above-mentioned reference U.S. Pat. No. 3,863,893 and is no part of the present invention, it is not deemed necessary to describe this mechanism in detail. It is only necessary to know that the rope or cable 21 passes through the apparatus between the jaws of two pairs of clamping jaws 22, 23 adapted, for pulling the tight end of the rope (opposite the anchoring hook 24), to be actuated by a lever 25 by means of control links 26, 27 pivotally connected to the jaw tightening linkage, so that the pair of jaws pulled forwards, i.e. towards the hook 24, by their control link will be tightened while the other pair of jaws is released or opened, and moved backwards. In this form of embodiment, the control lever 12 is the reverse or backward operation lever urged by springs 13 and 14, and pivoted to the rear levers of the two pairs of jaws so as to release the pair pulled forwards by actuating said lever 12. It is clear that when compressed the springs 13 and 14 exert on the pairs of jaws a pre-clamping pressure which is eliminated when the release strap 7 is pulled forwards, so that in this case the rope can be caused to move freely by hand through the winch.

Figure 2:
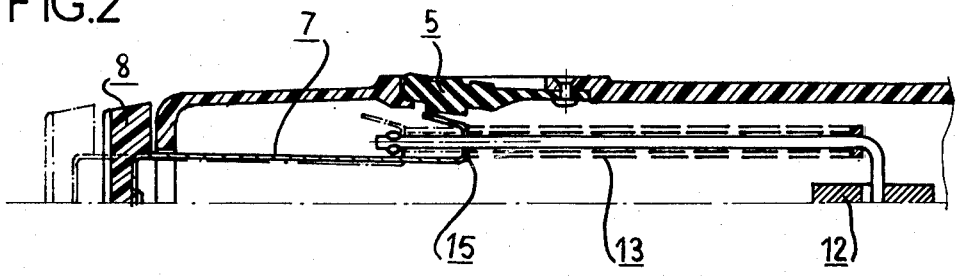
FIG. 2 is a half cross-section showing the device in the last position described, i.e. when a pressure is exerted on both lateral push members while maintaining the pressure on the end push knob, this Figure also showing in dash lines the position of the component elements of the device when the end push knob is released, the spring action being zero at that time.
Figure 3:
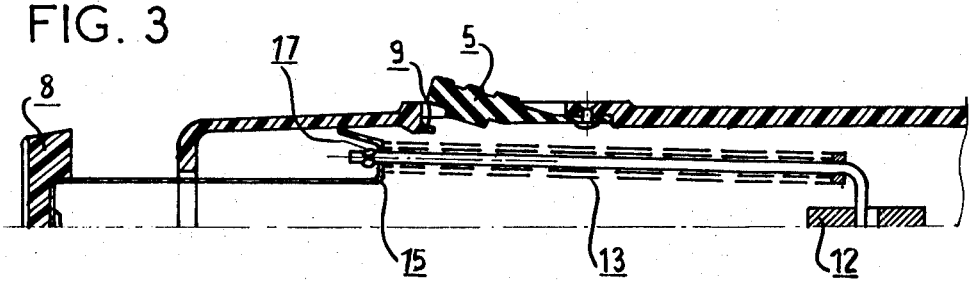
FIG. 3 is a half cross section showing the end position in which the jaws of the clamping system are open, the rope being thus free to move through the apparatus, this last position having been obtained by pulling the end push knob.
Figure 5:
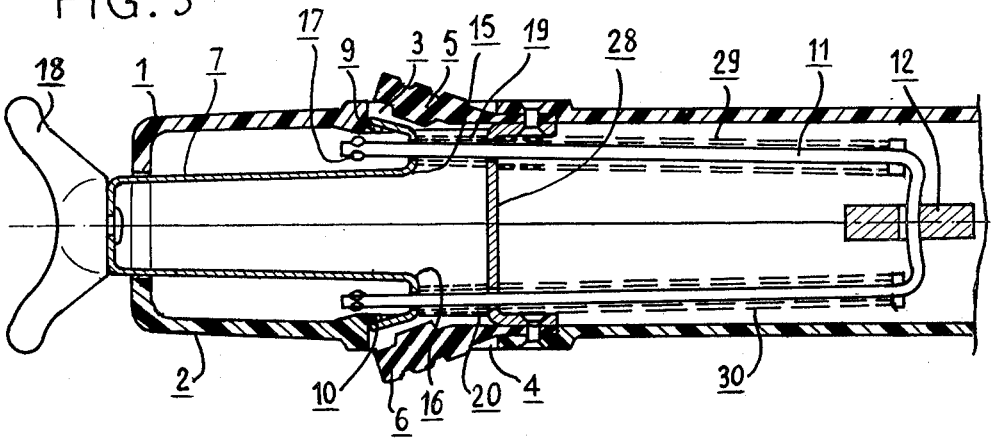
FIG. 5 is a fragmentary section similar to FIG. 1 concerning another form of embodiment wherein the outward movement of the release strap takes place against the action of the pre-clamping springs disposed as in the case of FIG. 1.
Figure 6:
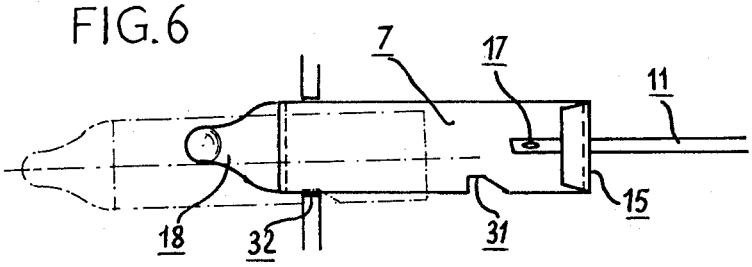
FIG. 6 is a front view of the release strap, showing in thick line its clutching position and in dash lines its release position.

In FIG. 5, the release strap 7 is also similar to that of FIGS. 1 to 3 but the end knob is replaced by a control handle 18 having a shape making it easier to pull than a knob against the force of the clamping springs. Compression release springs, provided around the arms of rod 11 and shown diagrammatically at 19 and 20, are interposed between the transverse portions 15, 16 of the ends of strap 7 and a fixed cross member 28 rigid with the casing of the apparatus, the arms of rod 11 extending freely through this cross member 28 so that the springs 13, 14 will push initially the ends of strap 7 to the left, as seen in the Figures, beyond the apertures 9, 10 when these ends are moved preliminary towards each other by exerting a simultaneous pressure on the lateral push members 5 and 6. Then the declutching action is obtained by simply pulling the handle 18 which pulls in turn the strap 7 outwardly, the latter carrying along the lever 12 against the resistance of pre-clamping springs 29, 30 surrounding the arms of rod 11 and disposed between the cross member 28 and the U-shaped bottom of this rod 11. The strap 7 is provided with a notch 31 (FIG. 6) adapted to latch the edge 32 of the aperture provided to this end in the casing 1 and receiving the strap 7 therein when the latter is moved to its release position shown in dash lines in FIG. 6.

Figure 7:
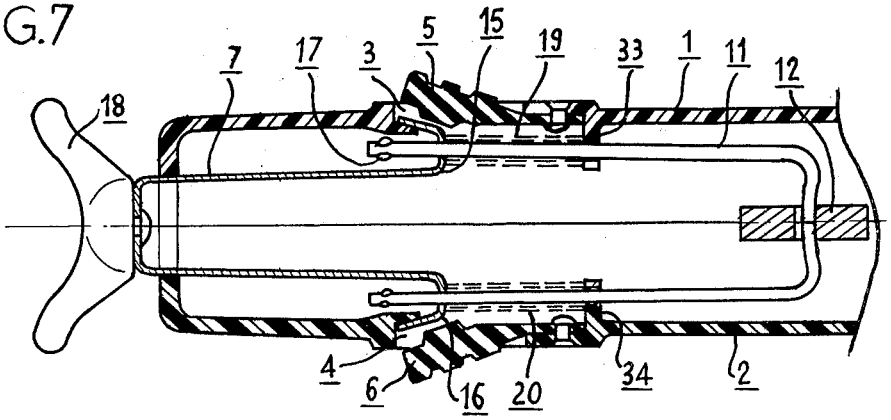
FIG. 7 is a fragmentary section similar to FIGS. 1 to 5 but showing a third form of embodiment of the invention.

In the third exemplary form of embodiment shown in FIG. 7, the release springs 19, 20 react against inner lugs 33, 34 formed integrally with the casing 1, 2 and the arms of rod 11 extend freely through holes formed in these lugs 33, 34. However, the pre-clamping springs which may be associated with the pairs of clamping jaws are not shown.

What I claim is:

1. An apparatus for hauling in and out a metal rope to which a load is attached, which comprises:

two pairs of self-clamping jaws acting by turns on the rope by performing a to-and-fro movement under the control of a linkage mechanism, a pre-clamping spring system acting on said pairs of jaws and adapted, when compressed, to cause the jaws of each pair to engage the rope so as to warrant at all time the self-clamping action of the pairs of jaws under the influence of the load, a release mechanism comprising:

(i) a release control strap slidably mounted in a casing of the apparatus, presenting an end push knob and two flexible substantially parallel arms having their ends bend outwardly, these flexible parallel arms being constantly urged from each other to bear against inner walls of the casing, (ii) a two arm transmission rod, connecting said release control strap to an actuating lever of said pairs of self-clamping jaws, each arm of said two arm transmission rod being adapted to slide in an opening of a transverse portion of said release control strap, (iii) a pair of pre-clamping compression springs from the pre-clamping spring system, each pre-clamping compression spring of said pair being associated with an arm of the two arm transmission rod and bearing at one end on said arm and at the opposite end on said transverse portion of the release control strap, (iv) a lateral aperture provided in each wall of the casing, said apertures registering, each one of said apertures ensuring the locking of said outwardly bent end of the corresponding arm of the release control strap when said release control strap is in a retracted position involving a pre-clamping action of said pair of pre-clamping compression springs, (v) a release actuator comprising a pair of push-members, each push-member of said pair being fixed in the aperture of a corresponding wall of the casing and being adapted, when actuated by an operator hand, to push inwardly the corresponding arm of the release control strap for unlocking same, thus allowing to move said release control strap to an expanded position in which the pre-clamping action of the pre-clamping compression springs in cancelled and said actuating lever is operated to open simultaneously both pairs of self-clamping jaws.

2. An apparatus as recited in claim 1, wherein each lateral aperture of the casing presents a bearing edge with an internal projection for reinforcing an hooking action exerted on the bent end of each strap arm by the corresponding bearing edge.

3. An apparatus as recited in claim 1, wherein the outwardly bent end of each arm of the release control strap makes an angle of more than ninety degrees with said transverse portion of the corresponding arm.

4. An apparatus for hauling in and out a metal rope to which a load is attached, which comprises:

two pairs of self-clamping jaws acting by turns on the rope by performing a to and fro movement under the control of a linkage mechanism, a pre-clamping spring system acting on said pairs of jaws and adapted, when compressed, to cause the jaws of each pair to engage the rope so as to warrant at all time the self-clamping action of the pairs of jaws under the influence of the load, a release mechanism comprising:

(i) a release control strap slidably mounted in a casing of the apparatus, presenting an end push knob and two flexible substantially parallel arms having their ends bent outwardly, these flexible parallel arms being constantly urged from each other to bear against inner walls of the casing, (ii) a two arm transmission rod, connecting said release control strap to an actuating lever of said pairs of self-clamping jaws, each arm of said two arm transmission rod being adapted to slide in an opening of a transverse portion of said release control strap, (iii) a pair of pre-clamping compression springs from the pre-clamping spring system, each pre-clamping compression spring of said pair being associated with an arm of the two arm transmission rod and bearing at one end on said arm and at the opposite end on a cross member of the casing, (iv) a pair of compression release springs, each compression release spring of said pair being associated with an arm of the two arm transmission rod and bearing at on end on said cross member of the casing and at the opposite end on said transverse portion of the release control strap, (v) a lateral aperture provided in each wall of the casing, said apertures registering, each one of said apertures ensuring the locking of said outwardly bent end of the corresponding arm of the release control strap when said release control strap is in a retracted position involving a pre-clamping action of said pair of pre-clamping compression springs, (vi) a release actuator comprising a pair of push members, each push member of said pair being fixed in the aperture of a corresponding wall of the casing and being adapted, when actuated by an operator hand to push inwardly the corresponding arm of the release control strap for unlocking same, thus allowing to move said release control strap, against the action of the pre-clamping compression springs but with the help of the action of said release compression springs, to an expanded position in which the actuating lever is operated to open simultaneously both pairs of self-clamping jaws;

5. Apparatus as recited in claim 4, wherein registering notches are provided on the arms of the release control strap so that these notches engage an edge of the casing, in the expanded position of the release control strap, so as to lock said strap in this position and prevent a return of said strap to its retracted position under the action of the pre-clamping compression springs.

6. An apparatus for hauling in and out a metal rope to which a load is attached, which comprises:

two pairs of self-clamping jaws acting by turns on the rope by performing a to-and-fro movement under the control of a linkage mechanism, a pre-clamping spring system acting on said pairs of jaws and adapted, when compressed, to cause the jaws of each pair to engage the rope so as to warrant at all time the self-clamping action of the pairs of jaws under the influence of the load, a release mechanism comprising:

(i) a release control strap slidably mounted in a casing of the apparatus, presenting an end push knob and two flexible substantially parallel arms having their ends bent outwardly, these flexible parallel arms being constantly urged from each other to bear against inner walls of the casing, (ii) a two arm transmission rod, connecting said release control strap to an actuating lever of said pairs of self-clamping jaws, each arm of said two arm transmission rod being adapted to slide in an opening of a transverse portion of said release control strap, (iii) a pair of compression release springs, each compression release spring of said pair being associated with an arm of the two arm transmission rod and bearing at one end on a fixed bearing point of the casing and at the opposite end on said transverse portion of the release control strap, (iv) a lateral aperture provided in each wall of the casing, said apertures registering, each one of said apertures ensuring the locking of said outwardly bent end of the corresponding arm of the release control strap when said release control strap is in a retracted position, (v) a release actuator comprising a pair of push members, each push member of said pair being fixed in the aperture of a corresponding wall of the casing and being adapted, when actuated by the operator hand, to push inwardly the corresponding arm of the release control strap for unlocking same, thus allowing, with the help of the action of the release compression springs, to move said release control strap to an expanded position in which the actuating lever is operated to open simultaneously both pairs of self-clamping jaws.

* * * * *